United States Patent [19]

McKay

[11] Patent Number: 4,605,229

[45] Date of Patent: Aug. 12, 1986

[54] TOY DRAGSTRIP AND STARTING TOWER

[76] Inventor: Robert S. McKay, 7420 Beckwith Rd., Morton Grove, Ill. 60053

[21] Appl. No.: 699,592

[22] Filed: Feb. 8, 1985

[51] Int. Cl.[4] ..... A63F 9/14

[52] U.S. Cl. ..... 273/86 R; 446/171

[58] Field of Search ..... 273/86 R; 446/168, 171

[56] References Cited

U.S. PATENT DOCUMENTS

| | | | |
|---|---|---|---|
| 3,707,802 | 1/1973 | Tucker et al. | 273/86 R X |
| 3,801,094 | 4/1974 | Treaster | 446/168 X |
| 4,291,878 | 9/1981 | Nagel et al. | 273/86 R |

*Primary Examiner*—Anton O. Oechsle

*Attorney, Agent, or Firm*—Haight, Hofeldt, Davis & Jambor

[57] ABSTRACT

A mechanical toy dragstrip having a base, and a starting tower disposed on the base. As in drag racing, two parallel car tracks and two car loading or starting positions are provided. The starting tower is used to signal the beginning of the race by displaying, in sequence, red, yellow and green marbles which simulate the lights of a dragstrip "Christmas tree". The marbles roll down a path in the tower and are displayed in apertures to simulate lights. As the green marble is displayed, a set of starting flags raise automatically, and toy vehicles may be launched from sets of trigger assemblies. The toy is arranged such that the cars may be released manually upon perception of the green "go" marble or such that one of the cars is released automatically after display of the green "go" marble upon raising of the starting flags to race against the other car which is released manually.

12 Claims, 8 Drawing Figures

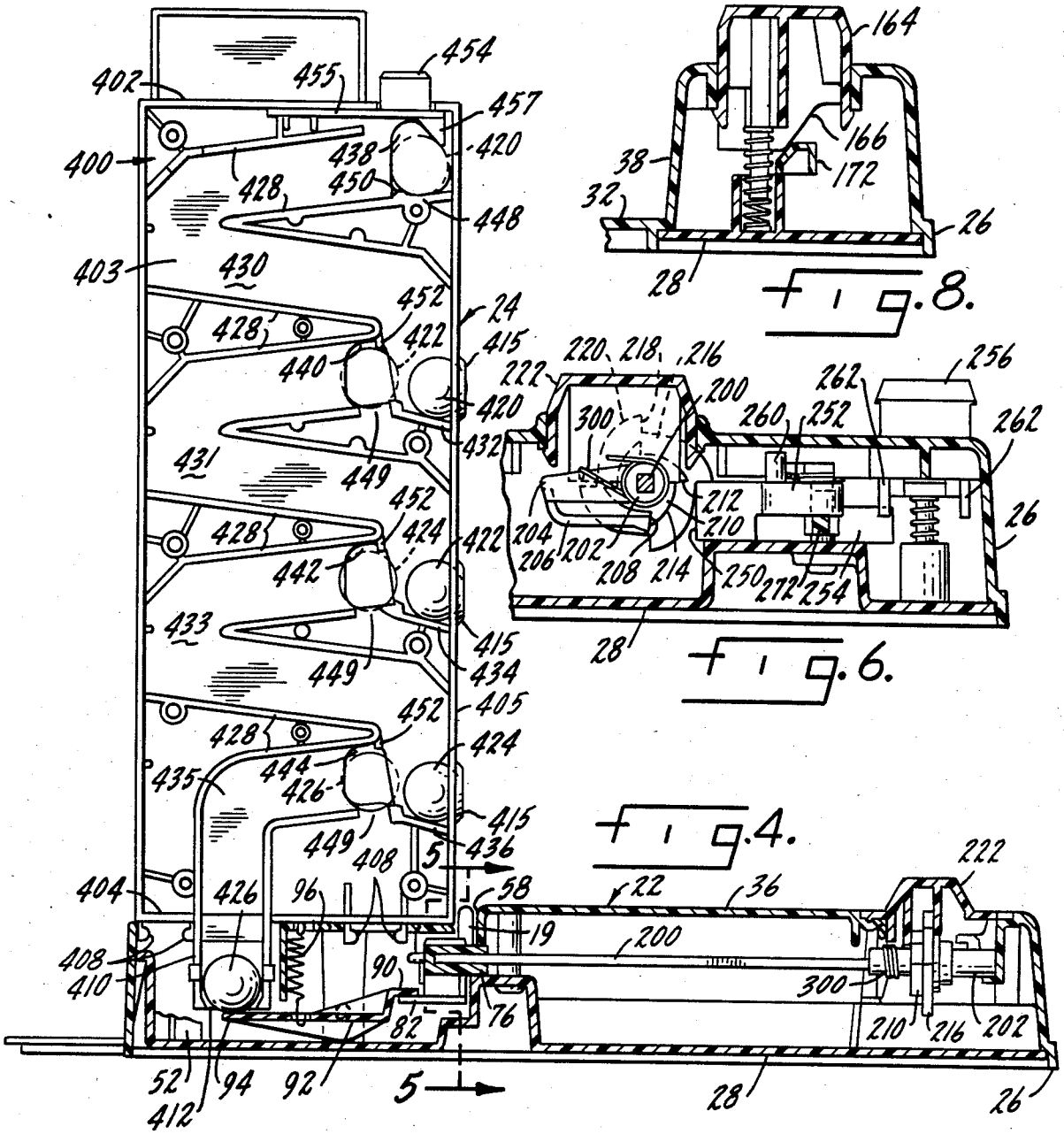
Fig. 8.
Fig. 6.
Fig. 4.
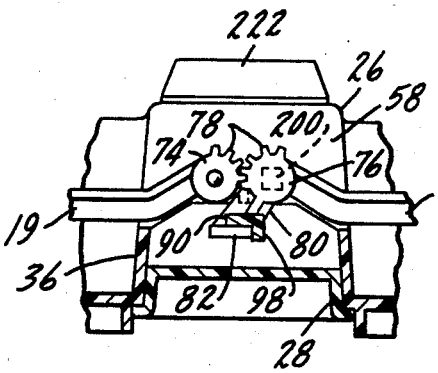
Fig. 5.
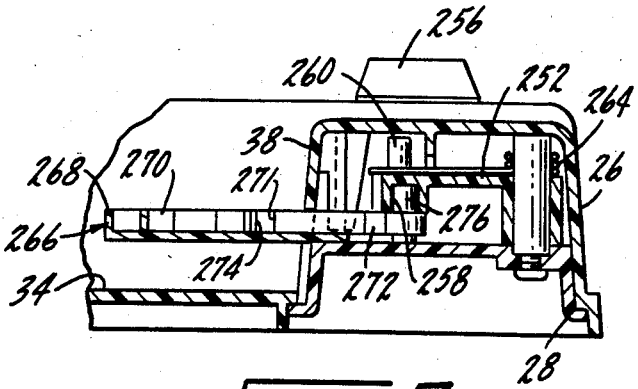
Fig. 7.

TOY DRAGSTRIP AND STARTING TOWER

BACKGROUND OF THE INVENTION

This invention relates to a toy dragstrip requiring no batteries or electric power. More particularly, the present invention provides a toy dragstrip which simulates an actual dragstrip, both in appearance and operation.

Toy racetracks are generally known, and it is known to create downscaled toy versions of actual racetracks, to simulate the actual racetracks. However, many of the known toy racetracks require some source of electrical power to operate. The present invention provides a novel simulation of an actual dragstrip that is purely mechanical in operation.

The present invention includes a novel starting tower disposed on a base, is used to signal the beginning of the race: red, yellow and green marbles roll down through the tower and are displayed, in sequence, in apertures formed in the tower to simulate the red, yellow and green lights of a dragstrip "Christmas tree". After the green marble is displayed, a set of starting flags raise automatically, and toy vehicles may be launched from starting gates on the base down a set of parallel tracks toward a finish line. The toy dragstrip may be reset for subsequent races by tilting the starting tower downwardly to return the marbles to their initial positions, and then returning the tower to its upright position. The cars are returned to the starting gates.

The present invention utilizes toy vehicles of the type having mechanical means for propulsion. These toy vehicles are known and are of the type described in U.S. Pat. No. 4,411,098. The cars have on each opening in the rear of the vehicle adapted to receive a means for actuating the vehicle's propulsion means, which takes the form of a coiled spring. As disclosed in U.S. Pat. No. 4,411,098, the coiled spring is compressed by key mechanisms inserted in the opening and released upon actuation of the key member. The key mechanism is a two-sided leaf spring with a latch which mates with a notch in the vehicle's opening, to hold the vehicle on the key. When the two sides of the key are squeezed together, the vehicle is released, and the compressed coiled spring propels the vehicle. The present invention utilizes a novel triqqer assembly to actuate the toy vehicle's propulsion means.

BRIEF DESCRIPTION OF THE DRAWINGS

FIG. 4 is a cross-sectional view of the vehicle launcher toy, taken along line 4—4 of FIG. 2;

FIG. 5 is a partial sectional view, taken along line 5—5 of FIG. 4, showing the base of the vehicle launcher toy;

FIG. 6 is a partial sectional view, taken along line 6—6 of FIG. 3, showing the base;

FIG. 7 is a partial sectional view, taken along line 7—7 of FIG. 2, showing the base;

FIG. 8 is a partial sectional view, taken along line 8—8 of FIG. 2, showing the base.

DETAILED DESCRIPTION OF THE ILLUSTRATED EMBODIMENT

In the accompanying drawings there is illustrated a toy dragstrip which embodies the principles of the present invention. The toy dragstrip simulates the appearance of an actual dragstrip. Like an actual dragstrip, the present invention provides a pair of starting gates and parallel tracks ending at a finish line; it has a starting tower which signals the beginning of a race by displaying simulated colored lights, with red, yellow and green in sequence. Like an actual drag race, the toy vehicles are initially at rest, but ready to proceed along the strip, or track, in parallel paths. The race commences by display of the lights of a dragstrip which in dragster parlance is known as a "Christmas tree". Red, meaning "stop", is followed by yellow, meaning "get ready", which is followed by green, which means "go". After the green signal is given, starting flags raise automatically, and the toy vehicles may be launched down the tracks toward the finish line.

The disclosed vehicle launcher toy may be used by one or two players. When two players participate, the toy may be set such that both toy vehicles are launched manually by the players. When only one player participates, the toy may be set so that one of the toy vehicles is launched automatically after the green "go" signal and after the starting flags raise. The player manually launches the other vehicle, thus allowing the player to race against the toy.

Figure 1:
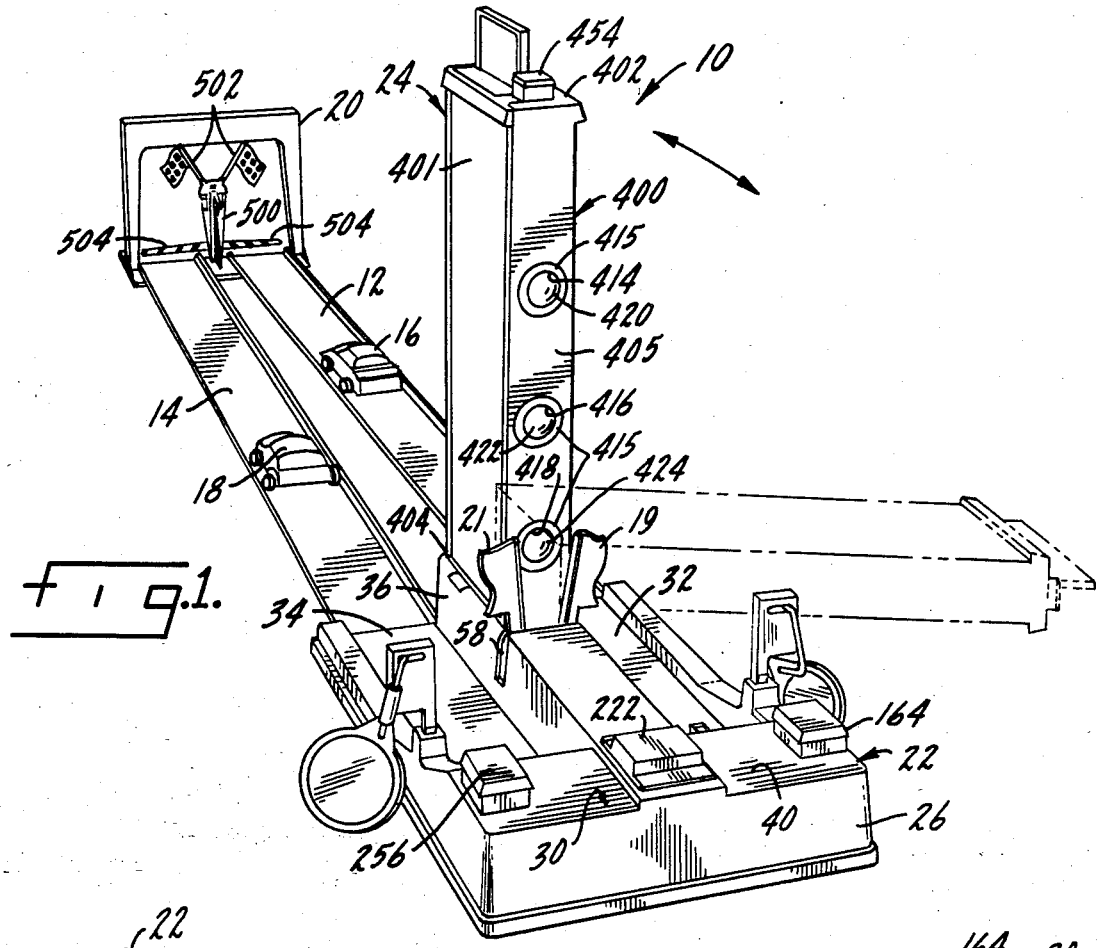
FIG. 1 is a perspective view of a vehicle launcher toy embodying this invention.

As illustrated in FIG. 1, the preferred embodiment of the toy dragstrip, generally designated 10, includes a set of parallel tracks, 12, 14, on which toy vehicles 16, 18, may be run. At one end, the tracks are slidably connected to a finish line assembly 20. At their opposite ends, the tracks are slidably connected to a base 22. The base 22 defines starting gates behind starting flags 19, 21. A starting tower 24 is removably disposed thereon.

The base 22 may be formed of any suitable material such as molded plastic. As illustrated, the base 22 has a two-piece body: a top piece 26 and a bottom piece 28. The two pieces may be joined by any suitable means, such as by screws. The top piece 26 of the base defines a T-shaped housing portion 30; it also defines two parallel vehicle starting gates or chutes 32, 34, separated by the central part 36 of the T-shaped housing 30. The chutes 32, 34 have closed ends 38 at the cross-piece 40 of the T-shaped housing 30 and are open at opposite ends 42 at the juncture of the base 22 and the tracks 12, 14.

Figure 2:
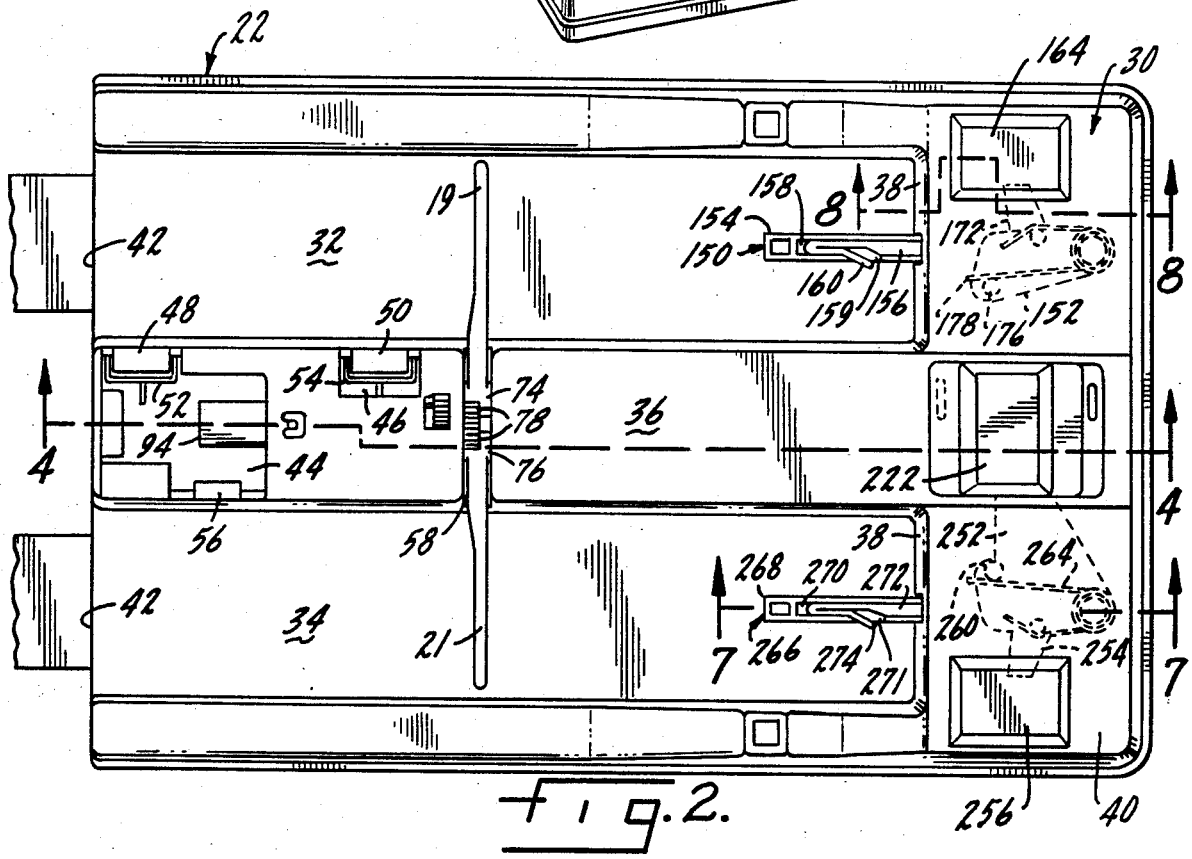
FIG. 2 is a top view of the base of the vehicle launcher toy, with the starting tower removed.

As shown in FIG. 2, the central part 36 of the T-shaped housing 30 defines a set of apertures and holding means adapted to releasably receive and hold the starting tower 24 on the base 22. The connection between the starting tower 24 and the base 22 provides a hinge means so that the starting tower may be reset for each race by tilting it downwardly and then returning it to an upright position as will be further explained.

A tower aperture 44 is located proximate to the opposite ends 42 of the chutes 32, 34. The tower aperture is generally rectangular in shape and extends substantially across the width of the central part 36 of the T-shaped housing 30. A hinge aperture 46 is located on one side of the central part 36 of the T-shaped housing, between the tower aperture 44 and the ends 38 of the chutes 32, 34. The two apertures 44, 46 are spaced to be compatible with the size of the starting tower 24.

Extending into the apertures 44, 46 from one side of the central part 36 of the housing 30 are lips 48, 50. Upright members 52, 54 extend upwardly from the bottom piece 28 of the base 22, and are positioned around the peripheries of the lips 48, 50. Each lip and associated upright member are adapted to receive complementary structures on the starting tower 24, to form a hinge means about which the starting tower may pivot. To retain the starting tower in an upright position on the base, a retaining lip 56 extends into the tower aperture from the side opposite the lip 48. The retaining lip 56 disengages from the starting tower when the tower is tilted downwardly, and snaps into place when the tower is upright.

As shown in FIG. 2, the central part 36 of the T-shaped housing 30 also includes a transverse slot 58, located between the hinge aperture 46 and the ends 38 of the chutes 32, 34. Starting flags 19, 21 extend through the transverse slot 58. The starting flags 19, 21 are spaced from the ends 38 of the chutes 32, 34 so that the toy vehicles 16, 18 may be placed in the starting gates between the flags and the rear walls 38.

The first starting flag 19 is integral with a first flag spindle 74 rotatably mounted on support structures in the interior of the central part 36 of the T-shaped housing 30. The second starting flag 21 is integral with a second flag spindle 76 rotatably mounted on support structures in the interior of the housing 30, proximate to the first spindle 74. Each flag spindle 74, 76 has an array of teeth 78 at its periphery, enmeshed with the teeth of the other spindle. Thus, the spindles 74, 76, rotate in unison so that both flags 19, 21 are simultaneously moveable between a lowered position where they are substantially horizontal, and a position where they are substantially vertical.

The second flag spindle 76 has a radial extension 80 extending from the periphery of the spindle. A spindle arm 82 is integral with the radial extension 80, and extends toward the tower aperture 44. The spindle arm 82 has a substantially flat surface. It rotates with the rotation of the flag spindles such that when the flags 19, 21 are substantially horizontal, the flat surface of the spindle arm 82 is in a horizontal plane.

The spindle arm 82 is proximate to a flag-setting end 90 of a lever 92. The lever is pivotably mounted in the interior of the central part 36 of the T-shaped housing 30, by pins extending from its sides, which pins are held in a support structure. The opposite end of the lever 92 is its actuator end 94. The actuator end of the lever extends into the space below the tower aperture 44. The actuator end 94 of the lever is biased upwardly, and the flag-setting end downwardly by a coiled spring 96 extending from the lever to the housing 30.

The flag-setting end 90 of the lever 92 defines a flat, horizontal surface and has a vertical lip 98 extending downwardly on one side of the lever. As shown in FIG. 5, when the spindle arm 82 is rotated into a substantially horizontal plane, the spindle arm is engaged below the lever 92 by the lip 98. Because the coiled spring 96 biases the flag-setting end 90 downwardly, the spindle arm 82 is retained and the flags 19, 21 are thereby set in a substantially horizontal position. Together, the spindle arm 82 and flag-setting end 90 of the lever 92 comprise a flag-setting means.

The illustrated simulated dragstrip toy also includes a set of vehicle actuating means. In the preferred embodiment, this set includes a manual vehicle actuating means associated with one chute 32, and a second vehicle actuating means that is operable both manually and automatically, which is associated with the second chute 34 as explained in aforementioned U.S. Pat. No. 4,411,098.

Figure 3:
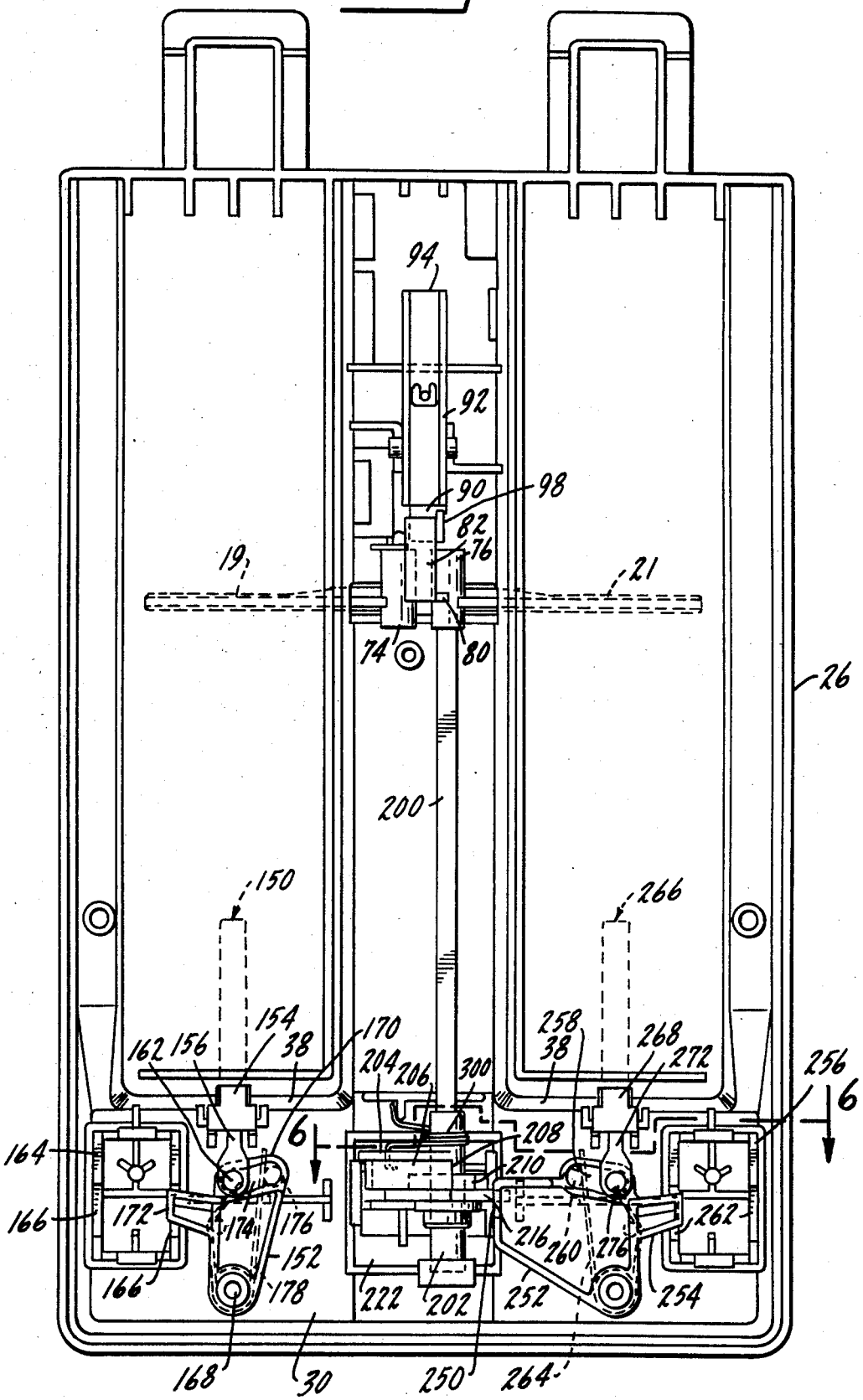
FIG. 3 is a bottom view of the base of the vehicle launcher toy, shown with the bottom cover removed.

The first manual vehicle release means includes a trigger assembly 150, actuated by a first vehicle release cam 152. As shown in FIGS. 2 and 3, the trigger assembly 150 extends through an aperture in the housing 30, the external part of the trigger assembly extending along the centerline of the chute 32. The trigger assembly is adapted to actuate the toy vehicle's mechanical means for propulsion.

The trigger assembly comprises a trigger guide 154 and a trigger 156. As shown in FIG. 2, the external part of the trigger guide 154 has walls defining a longitudinal channel 158. A gap 159 is formed on one side of the trigger guide 154. The external part of the trigger 156 is held within and is reciprocal within the longitudinal channel 158. The external part of the trigger 156 is hook-shaped, with the end of the hook defining a retractable latch 160 which extends through the gap in the wall of the trigger guide. The trigger assembly is adapted so that when the trigger is pushed forward into the longitudinal channel 158, the latch 160 is retracted. The trigger should be made of a resilient material such as plastic.

As shown in FIG. 3, the internal part of the trigger guide 154 is disposed within the cross-piece 40 of the housing 30, and is held in place by a support structure. The trigger 156 extends into the interior of the housing 30 through the trigger guide 154. At its interior end, the trigger 156 defines an upwardly extending trigger post 162.

The first manual vehicle release means also includes a first manual vehicle release button 164, disposed at one end of the cross-piece 40 of the housing 30. The top of the button 164 is external to the base 22, and its underside extends into the interior of the housing 30. The underside of the button has sides 166 which slope downwardly toward the end 38 of the chute 32.

Adjacent to the underside of the button 164 in the interior of the housing is the first vehicle release cam 152. The cam cooperates with the manual vehicle release button to actuate the trigger assembly. As shown in FIG. 3, the cam is rotatably mounted at one end on a post 168. The opposite end 170 of the cam is proximate to the end 38 of the chute 32. The side of the cam nearest the button 164 has a projecting member 172 in contact with one sloping side 166 of the button 164. As best seen in FIG. 8, the projecting member 172 is beveled at its point of contact with the sloping side 166, and is adapted to turn the cam toward the button as the button is depressed.

The opposite end 170 of the cam 152 defines an angled channel 174 adapted to serve as a guide means or cam slot for the trigger post 162. As shown in FIG. 7, the trigger post 162 extends upwardly into the channel 174. The channel 174 is angled such that as the cam turns toward the button 164, the trigger post travels in the channel 174 and is thereby moved toward the end 38 of the chute 32, thereby pushing the trigger 156 further into the trigger guide 154. It should be understood that cams shaped otherwise than the illustrated cam may be used in the present invention, as long as the cam performs the function of causing the trigger 156 to be pushed further into the trigger guide 154 as the button 164 is depressed. This movement causes latch 160 to retract inwardly of gap 159.

The cam 152 also has an upright member 176, extending upwardly from the end 170 of the cam. One end of a torsion spring 178 bears against the upright member, to bias the cam 152 away from the button 164.

The preferred embodiment of the present invention also includes a second vehicle actuating means that is operable both manually and automatically with the raising of the starting flags. To provide for this automatic release, the illustrated embodiment includes a drive shaft 200 coaxial with the second flag spindle 76, and mounted such that the drive shaft rotates with the rotation of the flag spindle. In the illustrated embodiment, the drive shaft is square in cross-section.

The drive shaft 200 extends from the second flag spindle 76 to an opposite end in the cross-piece 40 of the housing 30. At this opposite end, the drive shaft is mounted coaxially within a sleeve 202, such that the sleeve rotates with the rotation of the drive shaft. The end of the sleeve is rotatably mounted in a support member.

As shown in FIG. 6, the sleeve 202 includes a radial extension 204. At its end, the radial extension defines a sleeve arm 206. The opposite end 208 of the sleeve arm 206 defines a flat surface, spaced from the sleeve 202.

The end 208 of the sleeve arm 206 is proximate to one side of a pinwheel member 210. As shown in FIG. 6, the pinwheel member 210 is coaxial with the sleeve 202, and is rotatably mounted thereon, and is slidable, axially, thereon as well. The pinwheel member 210 has four shoulders 212, spaced approximately equidistant from each other. The shoulders are flat and extend radially inwards toward the center of the pinwheel member 210. The four shoulders 212 are connected by arcuate segments 214, which extend from the innermost edge of one shoulder to the outermost edge of the next shoulder.

A similarly shaped automatic release cam 216, integral with the pinwheel member 210, is rotatably mounted on the sleeve 202, and is slidable, axially, thereon. The automatic release cam is located on the side of the pinwheel member 210 opposite the sleeve arm 206. Like the pinwheel member 210, the automatic release cam 216 has four shoulders 218, joined by arcuate segments 220, which extend from the innermost edge of one shoulder in a relatively straight section, and then curve to the outermost edge of the next shoulder. However, the diameter of the automatic release cam 216 is greater than that of the pinwheel member 210.

The pinwheel member 210 and automatic release cam 216 are slidable between two positions on the sleeve 202. In a first position, the pinwheel member 210 is in contact with the end 208 of the sleeve arm 206. In a second position, the pinwheel member 210 is not in contact with the sleeve arm 206. Thus, in the first position, the sleeve arm 206 will cause the pinwheel member 210 and automatic release cam 216 to rotate with the rotation of the drive shaft 200. In the second position, the pinwheel member 210 and automatic release cam 216 will be free of the rotation of the drive shaft 200, and will not rotate when the starting flags rise. Together, the drive shaft 200, sleeve arm 206, and pinwheel member 210, comprise a means for rotating the automatic release cam with the raising of the starting flags.

To slide the pinwheel member 210 and automatic release cam between the two positions, switching means are provided. In the illustrated embodiment, the switching means comprises a selector switch 222 disposed at the center of the cross-piece 40 of the housing 30. The underside of the selector switch 222 provides support structures between which the pinwheel member 210 and automatic release cam 216 are held. The selector switch 222 is slidable between two positions to move the pinwheel member and automatic release cam between their two positions.

The periphery of the automatic release cam 216 is in contact with one side 250 of a second vehicle release cam 252. As shown in FIG. 6, at rest, one of the shoulders 218 of the automatic release cam 216 rests on top of the second vehicle release cam 252, and the straight section of one of the arcuate segments 220 is proximate to, or may bear against, the side 250 of the vehicle release cam 252. Thus, when the automatic release cam 216 is in the first position, a curved section of an arcuate segment 220 will bear against the side 250 of the vehicle release cam 252 as the automatic release cam 216 rotates, to push the vehicle release cam 252 away from the automatic release cam 216.

In other respects, the second vehicle release cam 252 is similar to the first vehicle release cam 152. The second vehicle release cam 252 includes a beveled projecting member 254 in contact with a second vehicle release button 256, the projecting member 254 being on the side of the vehicle release cam 252 opposite the side 250. The second vehicle release cam 252 also includes: a channel 258, disposed and constructed similarly to the channel 174 of the first vehicle release cam 152; and an upright member 260, disposed and constructed similarly to the upright member 176 of the first vehicle release cam 152. The second vehicle release cam is adapted to cooperate with either the automatic release cam or the second vehicle release button to actuate a second trigger assembly.

The second vehicle release button 256 is similar to the first button 164, with sloping sides 262 on its underside. A second torsion spring 264 is provided to bias the cam 252 away from the button 256.

A second trigger assembly 266, similar to the first trigger assembly 150, is associated with the second vehicle release cam 252. Like the first trigger assembly, the second trigger assembly 266 includes a trigger guide 268 having a longitudinal channel 270, and a gap 271 which exposes a trigger 272 having a retractable latch 274. A trigger post 276 disposed in the channel 258 of the cam 252.

A third torsion spring 300 is coiled around the sleeve 202, and has hooked ends. As shown in FIG. 3, one hooked end bears against the radial extension 204 of the sleeve. The third torsion spring serves as a means for biasing the flags 19, 21 in a substantially vertical position.

The present invention also includes a novel starting tower 24, illustrated in FIGS. 1 and 4, which simulates the dragstrip Christmas tree. Tower 24, defined by an elongated housing 400 of generally rectangular cross-section, having a top 402 and a bottom 404. A removable cover 401 closes one of the wide sides of the housing. The cover is removed in FIG. 4 for illustrative purposes. Back wall 403 is parallel to cover 401 and is integral with narrow side walls, one of which, designated 405, faces toward the vehicle release buttons 164 and 256. These housing elements may be conveniently formed of molded plastic.

The bottom 404 of the housing is adapted to sit on top of the base 22 when the tower is vertical. It includes two sets of latches 408. Both sets of latches are disposed on one side of the tower housing, and are adapted to be pressed into position around the lips 48, 50 and upright members 52, 54 in the apertures 44, 46 in the base. The bottom 404 of the tower housing 400 also defines a tower extension 410, extending downwardly from the bottom of the housing. The tower extension 410 is generally square in cross-section and is adapted to fit into the tower aperture 44 on the base 22 and to extend into the interior of the housing 30 of the base 22. The tower extension has an opening 412 at its end. As shown in FIG. 4, when the tower is set vertically on the base, the opening 412 is immediately above the actuator end 94 of the lever 92.

The housing 400 of the starting tower 24 also defines three apertures 414, 416, 418 in side wall 405 aligned vertically and defined by outwardly facing flanges 415 to simulate light fixtures at three vertically spaced positions.

Within the interior of the housing 400, the starting tower holds four spherical marbles: a first red marble 420, a second yellow marble 422, a third green marble 424, and an actuator marble 426. The diameters of the first, second and third marbles 420, 422, 424 are greater than the diameters of the marble apertures 414, 416, 418. The diameter of the actuator marble 426 is greater than the diameter of the opening 412 in the tower extension 410.

As best seen in FIG. 4, the interior of the housing has a plurality of webs 428 defining vertically spaced apart inclined marble paths 430, 431, 433, 435 commencing at the top of the interior of the housing and extending to the opening 412 in the tower extension 410. Each path is associated respectively with one of the marbles 420, 422, 424 and 426. Path 435 terminates in a vertical section above the opening 412.

A plurality of marble landings 432, 434, 436 are disposed at intervals and separate the inclined paths. Each marble landing is adjacent to on one side of, and associated with, one of the marble apertures 414, 416, 418. Each is angled downwardly toward the associated aperture. As one of the marbles 420, 422 or 424 transverses its associated path, it is captured and retained at the bottom of the path by landings 432, 434, 436 respectively. As marble 426 tranverses path 435, it is captured and retained at opening 412. When marbles 420, 422 and 424 come to rest on landings 432, 434 and 436 respectively, they are partially exposed through apertures 414, 416, 418 and appear as simulated red, yellow and green lights encircled by flanges 415.

A plurality of marble detent means 438, 440, 442, 444 are formed in back wall 403 at intervals along the paths. The first marble detent means 438 is located at the top of the path 430. The remaining marble detent means 440, 442, 444, are each respectively located at the top of one of the marble paths 431, 433, 435 adjacent to the marble landings 432, 434, 436.

Marble holding means are formed along the paths in the housing 400 of the tower. These means are adapted to releasably hold the marbles at the top of each path as indicated in phantom lines in FIG. 4 until the marbles are forced out of position and caused to travel downward to the positions shown in solid lines. The first marble holding means 448 is an abutment 450 formed at the top of first path 430. The remaining marble holding means are formed by gaps 449 in webs 428 adjacent landings 432, 434, 436. Abutments or stops 452 are formed in webs 428 above the gaps to restrict the travel of each marble to its associated path.

A marble release button 454 extends through top wall 402. It is integral with lever 455 within the housing 400 with one end immediately above the first marble holding means 448. The lever is elongated and secured to the housing at its end opposite button 454 by a support structure in the housing. The lever has a flange 457 adapted to push the first marble 420 over the first marble holding means 448 when the marble release button is depressed. The lever should be made of a resilient material so that it will return to its initial position when the button is released.

The finish line assembly 20 is arranged to reflect victory by one or the other of the cars 16 and 18. It includes a stanchion 500 pivotally supporting a pair of victory flags 502. The flags are joined together at a pivot point or may be integrally molded of plastic to pivot in unison. A pair of finish line barriers 504 are pivotally connected to stanchion 500 and are adapted to swing horizontaly between a position as shown in FIG. 1 across the ends of tracks 12 and 14 and open positions in which each is open to permit passage of one of the cars 16 and 18.

Levers associated with each barrier 504 (not shown) support the flags in a pivotally balanced position as illustrated in FIG. 1. Impact of one of the cars with one of the barriers 504 causes the associated lever to release its support of the flag assembly. The flags immediately pivot downwardly over the track in which the first impact with a barrier occurs, causing one flag to pivot over that track and indicate victory.

Operation of the vehicle launcher toy is as set forth below. First, tracks 12, 14 are slid onto the base 22. The opposite ends of the tracks 12, 14 are slid onto the finish line assembly 20. The starting tower 24 is connected to the base by pressing the latches 408 along the sides of the lips 48, 50 in the hinge aperture 46 and tower aperture 44.

The toy vehicles 16, 18 are each pressed onto the trigger assemblies 150, 266. Each trigger assembly fits into an opening in the rear of one of the vehicles. Such insertion compresses a power spring in each vehicle. The retractable latches 160, 274 on the ends of the triggers 156, 272 mate with means in the vehicles to hold the vehicles in position, ready for launching.

The second starting flag 21 is pushed downwardly. This causes the second flag spindle 76 to rotate. Because the teeth 78 of the first 74 and second 76 flag spindles are enmeshed, the first flag spindle rotates with the second flag spindle, and the starting flags lower in unison.

It is preferred that only the second flag 21 be pushed downward because the drive shaft 200, sleeve 202, third torsion spring 300, and spindle arm 82 are all associated with the second flag spindle 76.

As the second flag spindle 76 rotates, its arm 82 also rotates, until the arm is below the flag-setting end 90 of the lever 92. When the flags are substantially horizontal, the spindle arm is caught and held by the lip 98 on the lever 92. Thus, the flags are set in a substantially horizontal position, in front of the vehicles, transversely across the starting gates or chutes 32, 34.

As the second flag spindle 76 rotates, it also causes the drive shaft 200 and sleeve 202 to rotate. As the sleeve 202 rotates, the radial extension 204 compresses the third torsion spring 300.

The starting tower 24 is tilted downwardly, as shown in FIG. 1, until the top 402 of the tower is lower than the bottom 404. The tower pivots around the hinge means formed by the latches 408, lips 48, 50, and upright members 52, 54. With the tower so tilted, the marbles 420, 422, 424, 426 travel along the paths to the associated detent means 438, 440, 442, 444. The marbles are prevented from traveling beyond the detent means by the abutments 452. The starting tower 24 is then tilted upwardly until it is substantially vertical, with its bottom 404 resting on the base 22 and the marbles are directed by detent means 438, 440, 442, 444 into a position of rest in respective marble holding means 448 and 449 formed in webs 428.

If two players wish to play, the selector switch 222 is slid back, and the supporting structure on the underside of the switching means also moves back, bringing the automatic release cam 216 and the pinwheel member 210 back to the second position. In this position, the pinwheel member does not contact the sleeve arm 206, and the automatic release cam and pinwheel member do not rotate with the raising and lowering of the starting flags 19, 21.

To start the race, the marble release button 454 is depressed, forcing the flange 457 of marble release lever 454 against the first marble 420, to force the first marble out of the first marble holding means 448. The first marble travels down the marble path 430 to the first marble landing 432 where it comes to rest. The abutment 452 prevents the first marble from traveling any further down the marble path. The first marble remains on the first marble landing, where it is visible through the first marble aperture 414. The players see the red first marble in the first aperture to simulate a red stop light exposed in the aperture 414. The marble also strikes the second marble 422, thus forcing the second marble out of the second marble holding means 449.

The second marble 422 travels down the marble path 431 to the second marble landing 434 where it comes to rest. The abutment 452 prevents the second marble from traveling further down the marble path 431. The second marble remains on the second marble landing, where it is visible through the second marble aperture 416. The players can see the yellow second marble in the aperture to simulate a "get ready" light in the start sequence. The marble also strikes the third marble out of holding means 449.

The third marble 424 travels down the marble path 430 to the third marble landing 436 where it comes to rest. The abutment 452 prevents the third marble from traveling further down the path 433. The third marble remains on the third marble landing, where it is visible through the third marble aperture 418. The players can see the green third marble in the aperture which simulates a green or "go" light in the starting sequence of the simulated drag race. It also strikes actuator marble 426, thus forcing the actuator marble out of the actuator marble holding means 449.

The actuator marble 426 travels from its holding means down the path 435 to the vertical section of the path. The actuator marble drops to the opening 412 of the tower extension 410, where it strikes the actuator end 94 of the lever 92.

When the actuator marble strikes the actuator end 94 of the lever, the actuator end is forced downwardly. The lever 92 pivots, raising the flag-setting end 90 of the lever. As the flag-setting end of the lever is raised, the arm 82 of the second flag spindle 76 is released. Thus, the starting tower 24 and the lever 92 provide a means to release the flags from the flag-setting means.

With the arm 82 of the second flag spindle released, the third torsion spring 300 acts against the sleeve's radial extension 204, rotating the sleeve 202, drive shaft 200, and second flag spindle 76. As the second flag spindle rotates, the first flag spindle 74 rotates simultaneously, and the starting flags 19, 21 raise simultaneously. Because the pinwheel member 210 and automatic release cam 216 are not in contact with the sleeve arm 206, they do not rotate.

As the flags raise, the players each depress a manual vehicle release button 164, 256. As the buttons are depressed, the sloping sides 166, 262 of the buttons act against the projecting members 172, 254 of the vehicle release cams 152, 252, and the cams turn about their posts 168, towards the associated manual vehicle release buttons 164, 256. As the vehicle release cams turn, the trigger posts 162, 276 move along the channels 174, 258 of the vehicle release cams 152, 252, pushing the triggers 156, 272, further into the longitudinal channels 158, 270, of the trigger guides 154, 268, and thus retracting the retractable latches 160, 274. With the trigger latches retracted, the toy vehicles are propelled down the tracks toward the finish line. The first to reach the finish line will hit its associated barrier 504 and cause the finish line flags 502 to pivot into a position with one flag over the track in which the vehicle first activated the flag release levers.

When the manual vehicle release buttons 164, 256 are released, the torsion springs 178, 264 return the vehicle release cams 152, 252 to their initial at-rest position, pulling the triggers 156, 272 back to their initial positions.

To reset the starting tower 24, the tower is tilted downwardly about the hinge means, causing the marbles 420, 422, 424, 426 to return to the associated marble detent means 438, 440, 442, 444. When the tower housing 400 is pivoted back to vertical, the marbles are guided by detent means 438, 440, 442, 444 into marble holding means 448, 449, where the marbles are releasably retained until commencement of another race.

If a player wishes to play against the machine, the selector switch 222 is slid forward. The supporting structure on the underside of the selector switch also moves forward, bringing the pinwheel member 210 in contact with the end 208 of the sleeve arm 206. When the actuator marble 426 strikes the actuator end 94 of the lever, releasing the spindle arm 82 from the lever, the third torsion spring 300 acts against the radial extension 204, rotating the sleeve 202. The end 208 of the sleeve arm 206 acts against one of the shoulders 212 of the pinwheel member, causing the pinwheel member to rotate. As the pinwheel member rotates, the integral automatic release cam 216 rotates simultaneously. As the automatic release cam rotates, a curved section of an arcuate segment 220 pushes against the side 250 of the second vehicle release cam 252, causing the second vehicle release cam to turn about its post towards the second manual vehicle release button 256. As the second vehicle release cam turns, it actuates the trigger assembly and the trigger latch 274 is retracted, automatically releasing the toy vehicle as the starting flags raise.

When the automatic release cam 216 has rotated a one-quarter turn, the second torsion spring 264 returns the second vehicle release cam 252 to its initial, at-rest position, pulling the trigger 272 back to its initial position. In this mode of operation, the player releases his vehicle manually, as hereinabove described, in an attempt to beat the machine.

The lengths of paths 430, 431 and 433 are such as to provide an essentially equal period, or increment of time between exposure of the red, yellow and green marbles at apertures 414, 416, 418. This permits the player to anticipate when the green marble will appear. It is contemplated that additional yellow marbles could be employed in the game with appropriate additional apertures, paths and landings formed in the housing. In this way the timing sequence would be extended, for example, red, yellow, yellow, yellow, green, as the marbles sequentially traveled down their associated paths and appeared in their respective associated apertures.

Path 435 is relatively short, and essentially vertical to insure delivery of the actuator marble 426 within the reaction time of the user so that the gates raise before a player activates one of the cars. Also when playing in the automatic mode, actuator marble 426 causes release of one of the cars. Hence, the timing sequence permits the player to sharpen eye-hand coordination in seeking to release the manually controlled vehicle in time to beat the automatically released vehicle.

Modifications and/or additions may be included by those skilled in the art without departing from the scope of the invention as defined by the claims.

I claim:

1. A toy dragstrip for toy vehicles comprising;

a base defining at least two starting gates to receive toy vehicles therein, means to release said vehicles upon indication of a starting signal, a starting tower defined by an elongated housing having top and bottom ends, said bottom end being releasably pivoted to said base, for movement between a generally vertical position and an inclined position with the top end thereof disposed below the bottom end thereof, said housing including a wall defining a plurality of apertures, which, when said housing is in said vertical position, are spaced vertically one below the other, at least three marbles contained within said housing, each associated with one of said apertures, said housing including landings adjacent each of said apertures to receive one of said marbles at said aperture to expose at least a portion of said marble to the exterior of said housing through said aperture, said housing further including webs which, when said housing is in said vertical position, define inclined paths including a path for a first marble commencing adjacent the top end of said housing and termininating adjacent the vertically uppermost of said apertures, a path for a second marble commencing adjacent the landing for said first marble and terminating adjacent the next lowermost aperture, and a path for a third marble commencing adjacent the landing for said second marble and terminating adjacent the next lowermost aperture, marble holding means formed at the commencement of each said path for releasably holding said associated marble at the commencement of said path, marble release means accessible exteriorly of said housing and actuable to move said first marble from its marble holding means to cause it to travel along its inclined path to its landing, said movement causing said second marble to move from its marble holding means and to travel along its inclined path to its landing, said movement causing said third marble to move from its marble holding means and to travel along its inclined path to its landing.

2. A toy dragstrip as claimed in claim 1 wherein, upon pivotal movement of said housing to said inclined position, said marbles are caused to return to their respective marble holding means where they are releasably retained until actuation of said marble release means.

3. A toy dragstrip as claimed in claim 2 wherein said housing defines marble detent means adjacent each said marble holding means to receive said marbles upon return thereof to the commencement of their respective paths, said marble detent means delivering said marbles to said marble holding means upon pivotal movement of said housing to said vertical position.

4. A toy dragstrip as claimed in claim 1 wherein said first marble is red, said second marble is yellow, and said third marble is green.

5. A toy dragstrip as claimed in claim 1 wherein said base includes a starting flag associated with each said track, said flags connected for simultaneous movement between a substantially horizontal position across one of the tracks and a substantially vertical position, biasing means urging said starting flags to said vertical positions, setting means for setting said flags in said substantially horizontal position, and release means for releasing said setting means, said housing including at least a fourth marble, said housing including an opening in its bottom end overlying said setting means, and including webs, which when said housing is in said vertical position define an inclined path for said fourth marble commencing adjacent the landing for said third marble, and terminating at said opening in said bottom end, marble holding means formed at the commencement of said inclined path for said fourth marble for releasably holding said marble at the commencement of said path, said movement of said third marble causing said fourth marble to move from its marble holding means and to travel along its inclined path to said opening in said bottom end and actuate said release means.

6. A toy dragstrip as claimed in claim 5 wherein said first marble is red, said second marble is yellow, said third marble is green.

7. A toy dragstrip as claimed in claim 6 wherein upon pivotal movement of said housing to said inclined position, said marbles are caused to return to their respective marble holding means where they are releasably retained until actuation of said marble release means.

8. A toy dragstrip as claimed in claim 7 wherein said housing defines marble detent means adjacent each said marble holding means to receive said marbles upon return thereof to the commencement of their respective paths, said marble detent means delivering said marbles to said marble holding means upon pivotal movement of said housing to said vertical position.

9. A toy dragstrip as claimed in claim 1, wherein each said starting gate is adapted for use with a toy vehicle having mechanical means for propulsion, each such gate further comprising;

a trigger assembly associated with the base adapted to actuate a toy vehicle's mechanical means for propulsion, a manual vehicle release button disposed on the base, and a vehicle release cam associated with the base and cooperable with the manual vehicle release button to actuate the trigger assembly.

10. A toy dragstrip as claimed in claim 9 wherein the vehicle release cam includes a guide means; and the trigger assembly includes;

a trigger guide having walls defining a longitudinal channel and a gap in a wall of the trigger guide in communication with the longitudinal channel, a trigger held within and reciprocable within the longitudinal channel, the trigger having;

a retractable latch extendable through the gap in the wall of the longitudinal channel, a trigger post extending into the guide means of the vehicle release cam.

11. A toy dragstrip as claimed in claim 10, wherein the toy dragstrip is adapted for use with toy vehicles having mechanical means for propulsion, further comprising;

a trigger assembly associated with the base adapted to actuate the toy vehicle's mechanical means for propulsion, a rotatable automatic release cam associated with the base, rotating means on said base and connected for rotating the automatic release cam with the raising of the starting flags, a vehicle release cam associated with the base and cooperable with the automatic release cam to actuate the trigger assembly.

12. A toy dragstrip as claimed in claim 11 further comprising;

a manual vehicle release button disposed on the base and cooperable with the vehicle release cam to actuate the trigger assembly, and switching means associated with the base adapted to switch the automatic release cam from a first position where the automatic release cam rotates with the raising of the starting flags and a second position where the automatic release cam does not rotate with the raising of the starting flags.

* * * * *